United States Patent [19]

Ahlers

[11] 4,396,044

[45] Aug. 2, 1983

[54] RINSING APPARATUS FOR CLEANING FILLING ELEMENTS OF A FILLING MACHINE

[75] Inventor: Egon Ahlers, Neu-Bamberg, Fed. Rep. of Germany

[73] Assignee: Seitz-Werke GmbH, Bad Kreuznach, Fed. Rep. of Germany

[21] Appl. No.: 315,486

[22] Filed: Oct. 27, 1981

[30] Foreign Application Priority Data

Oct. 28, 1980 [DE] Fed. Rep. of Germany ..... 3040492

[51] Int. Cl.[3] ..... B65B 3/04

[52] U.S. Cl. ..... 141/90; 134/104; 137/240; 222/148; 239/119

[58] Field of Search ..... 141/1, 39, 4–8, 141/85–92; 134/104; 137/240; 222/148; 239/119

[56] References Cited

U.S. PATENT DOCUMENTS 3,964,526 6/1976 Sindermann ..... 141/90

*Primary Examiner*—Houston S. Bell, Jr.

*Attorney, Agent, or Firm*—Becker & Becker, Inc.

[57] ABSTRACT

A rinsing apparatus for microbiological cleaning of liquid-conducting zones of filling elements of a filling machine, such filling elements being provided with sealing structure in the region of outlets thereof. The apparatus includes a plurality of rinsing elements each having an interior chamber for receiving a fluid medium and each movable into an operative position for sealing co-operation with the sealing structure of a respective one of said filling elements, so that the fluid medium can transfer from the filling element outlet to the rinsing element chamber. Retaining members are provided for retaining each rinsing element in the operative position relative to the associated filling element. Each rinsing element additionally includes at least one outlet duct communicable with the lowermost region of the chamber for discharge of the fluid medium from the rinsing element. Communication between the or each outlet duct and the chamber is controlled by a valve arranged in the rinsing element.

8 Claims, 2 Drawing Figures

RINSING APPARATUS FOR CLEANING FILLING ELEMENTS OF A FILLING MACHINE

BACKGROUND OF THE INVENTION

The present invention relates to rinsing apparatus for microbiological cleaning of liquid-conducting zones of filling elements of a filling machine.

In German (Federal Republic) Pat. No. 2 747 501—Petzsch et al issued Aug. 14, 1980, there is described rinsing apparatus provided with different constructions of rinsing containers, one form of rinsing container construction being pressed during the rinsing treatment against a filling element by means of pneumatic lifting equipment associated with the filling element, so that the rinsing container closes a sealing seat in the region of the filling element outlet. For this purpose, it is necessary to load the lifting equipment of the filling elements with air during the rinsing treatment, for example with liquor, disinfectant solution and rinsing water, often lasting for hours, during which time air escapes from the lifting equipment and these leakage losses must be compensated for. Moreover, rinsing liquid remains in the rinsing containers after the conclusion of the rinsing treatment and, because there is no means of emptying the containers, they must be emptied by hand after being pushed out of the filling machine and before they are subsequently treated with disinfectant solution. This is also required in the case of the rinsing containers of the other form of construction described in the above-mentioned German patent, except that the lifting equipment in this case can be lowered during the rinsing treatment to an inoperative position, because the rinsing containers are only pressed on by means of the lifting equipment for the purpose of closing the sealing seats and are then held in the sealing position by special retaining devices associated with the filling elements. By contrast with the rinsing containers of the previously described form of construction, however, these containers are not suitable for intermediate rinsings and for the treatment of the filling elements by steam, because the retaining devices do not permit the lowering of the rinsing containers into an intermediate or "steaming" position. For steam treatment, a special set of rinsing containers must be provided, which increases costs and the use of which requires appreciable expenditure of time in the preparation of the machine for the next filling operation.

OBJECTS OF THE INVENTION

It is therefore the principal object of the present invention to provide rinsing apparatus for microbiological cleaning of filling machine filling elements, wherein the rinsing elements of the rinsing apparatus are, when fitted to the filling elements and when the machine is in operation or at standstill, suitable for steaming, optionally also for intermediate rinsing of the filling elements, and in addition are capable of being emptied.

Other objects and advantages of the invention will be apparent from the following description.

SUMMARY OF THE INVENTION

According to the present invention there is provided rinsing apparatus for microbiological cleaning of liquid-conducting zones of filling elements of a filling machine, the filling elements being provided with sealing means in the region of outlets thereof. The apparatus comprises a plurality of rinsing elements each with an interior chamber for receiving a fluid medium and each movable into an operative position to form a sealed joint with the sealing means of a respective one of the filling elements so that the fluid medium can transfer from the filling element outlet to the rinsing element chamber. Retaining means are provided for retaining each rinsing element in the operative position relative to the associated filling element. Each rinsing element additionally includes one or more outlet ducts communicable with the lowermost region of the chamber for discharge of the fluid medium from the rinsing element, communication between the outlet duct or ducts and the chamber being controlled by valve means arranged in the rinsing element.

With such apparatus, the interior chamber of each rinsing element can be vented according to requirements, whereby the requisite steam flow for steaming of the filling elements can be provided and the liquid tank of the filling machine can be emptied through the rinsing elements between individual rinsing phases during rinsing of the filling elements. The emptying of the rinsing elements can also be carried out without manual operation even before the discharge from the filling machine.

Expediently, the valve means is arranged on each rinsing element in a position enabling external operation thereof and is movable from a closed position to an open position for effecting communication of the outlet duct or ducts with the rinsing element chamber, or from the open position into the closed position for interrupting such communication by a stroke movement of the associated filling element or of raisable and lowerable lifting equipment allocated to that filling element. This arrangement of the valve means provides the advantage that pneumatic lifting equipment for the filling elements, or their own lifting equipment, can be restored to a starting position during the rinsing treatment so that the scope for air leakage from the lifting equipment is considerably reduced.

In connection with vacuum filling machine, there is described in United Kingdom Pat. No. 1 233 356, Cooper published May 26, 1971, rinsing apparatus with rinsing elements which are placeable by hand against the filling elements, each rinsing element being provided with a valve which, for improvement of the cleaning effect, permits entry of air into the rinsing element during operation of the filling machine and is movable into an open position through a cam mounted on the machine frame. These rinsing elements are, however, specially provided for a vacuum filling machine and adapted to the system thereof. The elements do not include outlet ducts leading into the open from the bases of the elements to enable steaming and intermediate rinsing and the controllable valves merely serve for the ingress of air and not for the control of outlet ducts for the discharge of rinsing liquid or steam. In addition, in these known rinsing elements the controllable valves are arranged well above the element bases, so that the elements can be emptied only by hand and then only after withdrawal from the vacuum filling elements.

BRIEF DESCRIPTION OF THE DRAWINGS

An embodiment of the present invention will now be more particularly described, by way of example only, with reference to the accompanying drawings, in which.

DESCRIPTION OF THE PREFERRED EMBODIMENT

Figure 1:
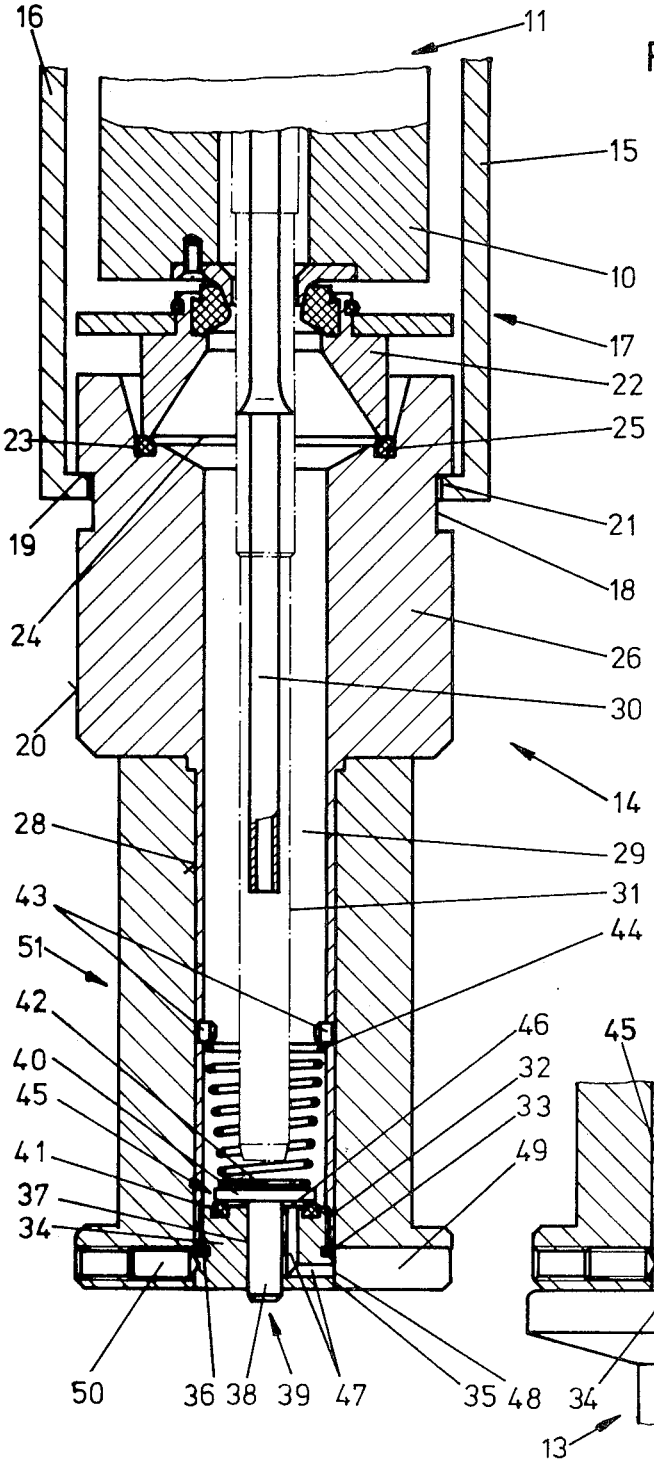
FIG. 1 is a longitudinal sectional elevation of a rinsing element of rinsing apparatus according to the said embodiment, and rinsing element being shown sealably fitted to the lower part of a filling element of a filling machine.

Referring now to the accompanying drawings, there is shown in FIG. 1 the lower part 10 of one of a plurality of filling elements 11 of a filling machine, which is equipped with rinsing equipment as described in German (Federal Republic) Pat. No. 2 747 501. Mounted on the lower part 10 of the illustrated filling element 11 is a rinsing element 14, which has been brought into sealing engagement with the filling element by a pneumatic lifting device 13 (FIG. 2) associated with the filling element. The lifting device 13 defines a support base 12 and normally serves for the pressing against the filling element outlet of a vessel to be filled. The rinsing element 14 is held in the described position by carrier arms 15 and 16 of a holder 17, which is also described in the above-mentioned German patent specification. The holder 17 is adapted for controlled engagement in a recess at the periphery 20 of the rinsing element 14, for example an annular groove 18 defining a shoulder 19, and for this purpose the two carrier arms 15 and 16 are each provided with an inwardly directed carrying lug 21. The lugs 21 are arranged in such a manner that, when inserted in the annular groove 18, the rinsing element 14 is retained in fully sealed engagement with a centering and sealing tulip 22 of the filling element lower part 10. The actual sealing of the tulip 22 with the rinsing element 14 is effected by a sealing ring 25, which is arranged in a groove 23 in the element 14 below the underside 24 of the tulip 22.

Both the groove 18 and the groove 23 are provided in a circular section base body 26 of the rinsing element 14, the groove 23 being present at the smallest diameter part of a frusto-conical bore 23 serving for alignment of the body 26 with the tulip 22. The body 26 is provided underneath the groove 18 with a cylindrical extension 28 of Niro-steel and the entire body 26 defines a passage bore 29 which extends along its longitudinal axis and effectively forms an interior chamber of the rinsing element 14. The bore 29 surrounds a gas feed tube 30 of the filling element 11, or a liquid filling tube 31 (indicated in chain-dotted lines) also of the filling element 11, at a radial spacing so as to provide a flow path, and is conically enlarged at its upper end as far as the sealing ring 25 so as to facilitate insertion of the gas feed tube 30 or liquid filling tube 31, as the case may be.

At its lower end, the bore 29 is provided with a thread 32, below which is a cylindrical turned recess 33 of greater diameter than the external diameter of the thread 32. Threadedly engaged in the thread 32 is a threaded closure member 34 with a collar 35, which has the same diameter as that of the extension 28 and which limits the depth of insertion of the closure member 34 into the extension 28. A sealing element 36 is inserted as a press fit in a groove in the closure member 34 and engages in the recess 33.

The closure member 34 is provided with a cylindrical bore 37 which has a diameter appreciably smaller than that of the bore 29 and which is co-axial with the bore 29. Guided in the bore 37 is a raisable and lowerable shank 38 of a valve body 39. Mounted on the shank 38 above the closure member 34 is a valve plate 40, the external diameter of which is smaller than that of the bore 29 but is appreciably larger than that of the shank 38. The underside of the plate 40 rests on an annular seal 41, which concentrically surrounds the shank 38 at a radial spacing and which is inserted into the upper end face—defining the base of the interior chamber of the rinsing element—of the closure member 34.

Acting on the upper side of the plate 40 is a conical compression spring 44, which is supported by a plurality of lugs 43 inserted in the wall of the bore 29 and centered by means of a projection 42 on the upper side of the plate 40. The force exerted by the spring 44 is less than the gravity force represented by the weight of the rinsing element.

The length of the shank 38 of the valve body 39, which body together with the annular seal 41 form a controllable valve 45, is such that the free end portion of the shank 38 protrudes below the lowermost face of the closure member 34 by an amount equal to the operating stroke of the valve body 39 between open and closed settings of the valve 45.

An entry opening 46 for an outlet channel 47, which extends angularly in the closure member 34 and an exit opening 48 of which lies at the peripheral surface of the collar 35, is provided in the annular space between the shank 38 and the annular seal 41. An outlet groove 49 of a centering body 51, which is arranged on the extension 28 of the base body 26 and secured by a threaded pin 50 to the collar 35, is disposed opposite to the exit opening 48. The centering body 51, which expediently consists of plastics material, ends flush with the lower face of the closure member 34 so to define the underside of the rinsing element 14. The diameter of the centering body 51 is related to that of the body of a bottle to be filled by the filling machine, apart from a region directly above the rinsing element underside, and can be replaced by centering bodies of other diameters after removal of the threaded pin 50. In place of a single outlet channel 47 and associated outlet groove 49, a plurality of such outlet channels and outlet grooves can be provided in the closure member 34 and centering body 51 according to requirements.

To enable "steaming" of the filling machine before start of a filling operation, the rinsing element 14 provided for each filling element 11 is brought into the operative position in sealing juxtaposition with the tulip 22 and the filling element lower part 10 by means of the lifting device 13, which is loaded by compressed air during rotation of the filling machine, and is fixed in this position at the filling element outlet. The fixing is effected by the lugs 21, which are pivoted into the groove of the base body 26 below the shoulder 19.

Figure 2:
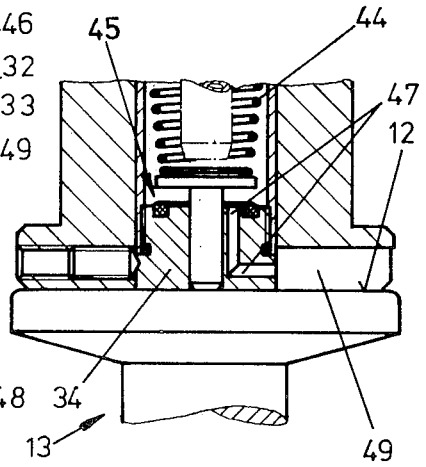
FIG. 2 is a detail, to an enlarged scale, of a controllable valve of the rinsing element of FIG. 1, showing the valve held in an open setting by a lifting device.

In this procedure, the valve body 38 is raised against the force of the spring 44 on contact of the base 12 of the lifting device 13 with the lowermost part of the rinsing element, namely the shank 38, whereby the plate 40 is raised from the annular seal 41 and the valve 45 is thus opened (FIG. 2). With a liquid valve of the filling element 11 opened subsequently, steam introduced into a liquid tank of the filling machine can pass through the filling element outlet to the region of the tulip 22 and tube 30 or 31 enclosed by the rinsing element 14. The steam then flows down the annular gap between the wall of the bore 29 and the outside of the tube 30 or 31 and passes through the opened valve 45, the outlet channel 47 and the outlet groove 49 into the open. This path is also taken by the condensate generated during the steam treatment.

When the steaming operation is concluded, the valve 45 can be closed by lowering of the lifting equipment 13, so that ingress of bacteria harmful to drinks or other liquid to be filled into the bottles, which is possible during cooling-down of the filling equipment of the filling machine, through the outlet channel 47 is avoided.

For rinsing of liquid-conducting parts of the filling machine after filling of liquid into bottles by the machine, the rinsing elements 14 are, as for the steaming operation previously described, brought into sealing engagement with the filling elements 11 by means of the pneumatic lifting devices 13 and are fixed over the filling element outlets by the holders 17. On subsequent lowering of the lifting devices 13 through relief of the air pressure therein, the valves 45, which were opened by the contact with the lifting device bases 12 when the rinsing elements 14 were moved into the sealing position, are closed. The rinsing operation can now be carried out in usual manner.

For intermediate rinsings which oblige emptying of the liquid tank of the filling machine through the filling elements 11 with issue of the liquid into the open, the valves 45 of the rinsing elements 14 are moved into the open position. This is again effected by means of the bases 12 of the lifting devices 13, which for this purpose are pneumatically loaded. The liquid to be emptied out of the liquid tank then issues through the open valves 45, the outlet channel or channels 47 of the outlet grooves 49 into the open. The described open position of the valves, effected by the bases 12 of the lifting devices 13, also applies at the end of the rinsing operation to enable emptying of the rinsing elements 14, so that any liquid in the rinsing element can flow out into the open. If the lugs 21 are subsequently removed from the annular groove 18 of each rinsing element 14 and the associated lifting device 13 lowered, the empty rinsing elements 14 are released from their sealing position and be removed one after the other from the filling machine.

In plant for filling only one kind of bottle, it may be advantageous to construct the rinsing element 14 without the extension 28 of the base body 26. In this case, the base body 26 and centering body 51 can be united and the unit can have a diameter, in the region formerly occupied by the body 51, which corresponds to the diameter of the bottles to be filled.

In the above-described embodiment the rinsing elements 14 are each brought into sealing engagement with the tulip 22 and the lower part 10 of the associated filling element 11 by a lifting device which is arranged below the filling element 11. The lifting device raises into filling position a vessel placed on the base 12 and sealingly presses the vessel against the filling element 11. In place of an individual lifting device 13 for each filling element 11, a common base can be provided for all filling elements and each filling element or at least the lower part thereof can be constructed to be lowerable to this common base so that the rinsing element 14 is brought into sealing engagement with the filling element lower part and the valve 45 is opened.

It will be readily apparent that the rinsing elements 14 can also be brought by hand into sealing engagement with the filling element lower parts 10 and held by, for example, the previously described retaining device or other suitable retaining equipment mounted on the rinsing element. In that case, the controllable valve 45 can be controlled and held in the open position in the aforedescribed manner by the lifting device 13, by displacing means associated with the filling element 11 or the lower part thereof, or by hand.

The present invention is, of course, in no way restricted to the specific disclosure of the specification and drawing, but also encompasses any modifications within the scope of the appended claims.

I claim:

1. Rinsing apparatus for microbiological cleaning of liquid-conducting zones of filling elements of a filling machine rinsed with both steam and fluid medium, wherein said filling elements are provided with sealing means in the region of outlets thereof, said apparatus in combination comprising a plurality of rinsing elements each defining an interior rinsing element chamber for receiving a fluid medium and each movable into an operative position for sealing co-operation with said sealing means of a respective one of said filling elements to permit transfer of said fluid medium from said filling element outlet into said rinsing element chamber without any pressure medium; retaining means for retaining each said rinsing element in said operative position relative to said respective filling element; means in each said rinsing element to define at least one outlet duct communicable with the lowermost region of said rinsing element chamber for discharge of said fluid medium from said rinsing element; and controllable valve means arranged in each said rinsing element respectively and operable to control effecting and shutting-off communication of each said outlet duct respectively with said rinsing element chamber.

2. Rinsing apparatus in combination according to claim 1, wherein each said filling element comprises displacing means for effecting reciprocatory movement thereof, said valve means of each said rinsing element being so arranged as to be movable by said displacing means of the respective filling element, in one stroke direction of said displacing means, into an open setting effecting communication of the or each said outlet duct of said filling element with said chamber thereof and, in the opposite stroke direction of said displacing means, into a closed setting preventing communication of the or each said outlet duct with said chamber.

3. Rinsing apparatus in combination according to claim 1, comprising raising and lowering means for raising and lowering each said rinsing element relative to said respective filling element, said valve means of each rinsing element being so arranged as to be movable by said raising and lowering means, in one direction of movement thereof, into an open setting effecting communicating of the or each said outlet duct of said respective filling element with said chamber thereof and, in the opposite direction of movement of said raising and lowering means, into a closed setting preventing communication of the or each said outlet duct with said chamber.

4. Rinsing apparatus in combination according to claim 3, wherein said valve means of each said rinsing element is so arranged at the base of the rinsing element as to be engageable by and movable with said raising and lowering means.

5. Rinsing apparatus in combination according to claim 4, wherein each said rinsing element is provided in the base thereof with means defining a vertical guide bore and with an annular seal member arranged concentrically with said guide bore at a radial spacing there-from; said valve means of each said rinsing element comprises a shank portion slidably engaged in said guide bore and arranged, in said closed setting of said valve means, to project at a lower end portion thereof below the lowermost surface of said rinsing element base by an amount substantially equal to the displacement travel of said valve means between said open and closed settings, and a head portion mounted on the upper end of said shank portion to co-operate with said annular seal; and a compression spring is arranged in said chamber of each said rinsing element to bias said valve member towards said annular seal; the or each said outlet duct of each said rinsing element communicating at one end thereof with said rinsing element chamber between said guide bore and said annular seal and at the other end thereof with the periphery of said rinsing element above said lowermost surface of said rinsing element base.

6. Rinsing apparatus in combination according to claim 5, wherein said compression spring in each said rinsing element chamber is frusto-conically shaped, means being provided at the wall of said chamber to support said spring.

7. Rinsing apparatus in combination according to claim 5 or 6, wherein each said rinsing element comprises a hollow main body portion and a closure portion which is threadedly coupled to said main body portion to close said main body portion at an end thereof and which is provided with said annular seal, with said valve means and with a section of the or each said outlet duct, said duct section opening at the periphery of said closure portion and the remaining section of the or each said duct comprising a channel arranged in said main body portion to communicate with said duct section in said closure portion.

8. Rinsing apparatus in combination according to claim 7, said main body portion of each said rinsing element comprising a base body and a centering body mounted on said base body, said closure portion being threadedly engaged in said base body and said remaining duct section being provided in said centering body.

* * * * *